US008593438B2

(12) United States Patent
Komatsu et al.

(10) Patent No.: US 8,593,438 B2
(45) Date of Patent: Nov. 26, 2013

(54) ELECTROPHORETIC DISPLAY AND ELECTRONIC DEVICE

(75) Inventors: Yuko Komatsu, Suwa (JP); Takashi Sato, Chino (JP)

(73) Assignee: Seiko Epson Corporation, Tokyo (JP)

( * ) Notice: Subject to any disclaimer, the term of this patent is extended or adjusted under 35 U.S.C. 154(b) by 292 days.

(21) Appl. No.: 13/027,673

(22) Filed: Feb. 15, 2011

(65) Prior Publication Data

US 2011/0205195 A1 Aug. 25, 2011

(30) Foreign Application Priority Data

Feb. 19, 2010 (JP) ..... 2010-034748

(51) Int. Cl.
*G09G 5/00* (2006.01)

(52) U.S. Cl.
USPC ..... 345/204; 345/87; 359/296

(58) Field of Classification Search
USPC ..... 345/87, 107, 204; 204/600; 359/296
See application file for complete search history.

(56) References Cited

U.S. PATENT DOCUMENTS

| | | | | |
|---|---|---|---|---|
| 7,602,452 | B2 | 10/2009 | Kato et al. | |
| 7,615,481 | B2 | 11/2009 | Araumi | |
| 7,704,859 | B2 | 4/2010 | Sato | |
| 7,961,171 | B2 | 6/2011 | Miyasaka et al. | |
| 2003/0007108 | A1* | 1/2003 | Hwang et al. | 349/43 |
| 2008/0001857 | A1* | 1/2008 | Yoo | 345/76 |
| 2008/0143664 | A1* | 6/2008 | Nakagawa | 345/92 |
| 2009/0167744 | A1* | 7/2009 | Horibata | 345/211 |
| 2009/0207113 | A1* | 8/2009 | Lee et al. | 345/87 |
| 2009/0207114 | A1* | 8/2009 | Terasaka | 345/89 |
| 2010/0001988 | A1* | 1/2010 | Kim | 345/214 |
| 2010/0033804 | A1* | 2/2010 | Aoki | 359/296 |

FOREIGN PATENT DOCUMENTS

| | | | |
|---|---|---|---|
| JP | 2003-535355 | A | 11/2003 |
| JP | 2004-081826 | A | 3/2004 |
| JP | 2007-102148 | A | 4/2007 |
| JP | 2007-316110 | A | 12/2007 |
| JP | 2008-020774 | A | 1/2008 |
| JP | 2008-134600 | A | 6/2008 |
| JP | 2008-147614 | A | 6/2008 |
| JP | 2008-151826 | A | 7/2008 |
| JP | 2008-225514 | A | 9/2008 |
| WO | WO-01-07961 | A | 2/2001 |

* cited by examiner

*Primary Examiner* — Amare Mengistu
*Assistant Examiner* — Premal Patel
(74) *Attorney, Agent, or Firm* — ALG Intellectual Property, LLC

(57) ABSTRACT

An electrophoretic display includes a first substrate, a second substrate, an electrophoretic element interposed therebetween, a plurality of scanning lines on an electrophoretic element side surface of the first substrate, a plurality of data lines extending in the crosswise directions of the plurality of scanning lines on the electrophoretic element side surface of the first substrate, a selection transistor connected to one of the scanning lines and one of the data lines, a pixel electrode connected to the selection transistor, and a capacitor with two electrodes, one of the electrode thereof being connected to the selection transistor and the pixel electrode, and the other electrode thereof being connected to one of the scanning lines, wherein a plurality of pixel electrodes are arranged so that a dot density thereof is more than or equal to 200 dpi.

11 Claims, 17 Drawing Sheets

LIQUID CRYSTAL

ELECTROPHORESIS

FIG. 9

| RESOLUTION [dpi] | Cep [pF] | Cgd [pF] | EXISTING | | PRESENT INVENTION | |
|---|---|---|---|---|---|---|
| | | | MAXIMUM Cs [pF] | 2*Vb [V] | MAXIMUM Cs [pF] | 2*Vb [V] |
| 100 | 4.85 | 0.06 | 11.62 | 0.04 | 12.34 | 0.04 |
| 200 | 1.21 | | 2.45 | 0.17 | 2.90 | 0.15 |
| 300 | 0.54 | | 0.89 | 0.42 | 1.24 | 0.34 |
| 400 | 0.30 | | 0.42 | 0.79 | 0.73 | 0.57 |

ELECTROPHORETIC DISPLAY AND ELECTRONIC DEVICE

CROSS-REFERENCE TO RELATED APPLICATION

This application is based on and claims priority from Japanese Patent Application No. 2010-034748, filed on Feb. 19, 2010, the contents of which are incorporated herein by reference.

BACKGROUND

1. Technical Field

The present invention relates to an electrophoretic display and an electronic device.

2. Related Art

An electrophoretic display, which includes a base plate, an opposite plate, and electrophoretic elements having electrophoretic particles dispersed in their respective medium interposed between the base and opposite plates, is well known. For example, in an electrophoretic display disclosed in JP-A-2008-20774, a base plate includes a plurality of pixel electrodes arranged in a matrix, selection transistors each connected to the respective pixel electrodes, capacitors each connected to drains of the respective selection transistors and pixel electrodes. Further, the base plate is configured to form a first capacitor and a second capacitor connected in parallel with each other to store sufficient electric charges in the capacitors.

Through researches conducted by the present inventors, it was found that the intensity difference is likely to appear in a half tone image. Feed-through effect in a selection transistor employed in an electrophoretic display may highly influence the uniformity of image density compared with that in a liquid crystal display. In the electrophoretic display, signal current flows into a capacitor via the selection transistor.

Since the field-through occurs due to a parasitic capacitance of the selection transistor, the influence exerted by the effect can be reduced by increasing a capacitance of a capacitor formed in a pixel. Therefore, as disclosed in JP-A-2008-20774, an electrophoretic display may employ a configuration in which two capacitors are laminated. That is, a capacitor using a gate insulating film is displaced above another capacitor using an interlayer insulating film.

However, the electrophoretic display disclosed in JP-A-2008-20774 has a disadvantage in that, since the upper capacitor is formed in a process different to the process for forming the lower capacitance, the total capacitance of the two capacitors may vary more widely. Further, the electrophoretic display has another disadvantage in that, since the upper capacitor uses a thick interlayer insulating film, it is difficult to increase the capacitance of the upper capacitor.

SUMMARY

An advantage of some aspects of the invention is to provide an electrophoretic display which enables suppression of influences exerted by field-through occurring in a pixel switching element, and realization of uniformity of image density.

An electrophoretic display according to a first aspect of the invention includes a first substrate and a second substrate configured to include an electrophoretic element interposed therebetween, wherein, on a surface at the electrophoretic element side of the first substrate, the first substrate includes a plurality of scanning lines and a plurality of data lines configured to extend in respective directions so that any one of the scanning lines and any one of the data lines can intersect with each other, a selection transistor configured to be connected to a first one of the scanning lines and a first one of the data lines, a pixel electrode configured to be connected to the selection transistor, and a capacitor configured to have two electrodes, one electrode thereof being connected to the selection transistor and the pixel electrode, the other electrode thereof being formed by a second one of the scanning lines, and further, the pixel electrode is formed so that a dot density thereof is more than or equal to 200 dpi.

According to this first aspect, since, in each pixel area, the pixel electrodes are formed so that a dot density thereof is more than or equal to 200 dpi, it is possible to reduce an amount of variation of an effective voltage, which depends on a parasitic capacitance. That is, increasing the storage capacitance of the capacitor leads to reducing a ratio of the parasitic capacitance Cgs relative to the storage capacitance Cs, and thus, reduces an amount of variation of the effective voltage. Owing to this configuration, it is possible to reduce an amount of variation of each of gray scales for a displayed image.

Further, providing a capacitor having the other electrode that is formed by a second one of the scanning lines causes the electric potential of a pixel electrode to vary in accordance with the electric-potential change of the second one of the scanning lines, and thus, enables achievement of effects of reducing occurrences of an image retention, and increasing response speeds.

An electrophoretic display according to a second aspect of the invention includes a first substrate and a second substrate configured to include an electrophoretic element interposed therebetween, wherein, on a surface at the electrophoretic element side of the first substrate, the first substrate includes a plurality of scanning lines and a plurality of data lines configured to extend in respective directions so that any one of the scanning lines and any one of the data lines can intersect with each other, a selection transistor configured to be connected to a first one of the scanning lines and a first one of the data lines, a pixel electrode configured to be connected to the selection transistor, and a capacitor configured to have two electrodes, one electrode thereof being connected to the selection transistor and the pixel electrode, the other electrode thereof being formed by a second one of the scanning lines, and further, a parasitic capacitance Cgs of the selection transistor is less than or equal to 1% of a capacitance Cs of the capacitor.

According to this second aspect, since, for each pixel area, a ratio of the parasitic capacitance Cgs of the selection transistor relative to the storage capacitance Cs of the capacitor is less than or equal to 1%, it is possible to reduce an amount of variation of an effective voltage, which depends on a parasitic capacitance. That is, increasing the storage capacitance of the capacitor leads to reducing a ratio of the parasitic capacitance Cgs relative to the storage capacitance Cs, and thus, reduces an amount of variation of the effective voltage. Owing to this configuration, it is possible to reduce an amount of variation of each of gray scales for a displayed image.

Further, providing a capacitor having the other electrode that is formed by a second one of the scanning lines causes the electric potential of a pixel electrode to vary in accordance with the electric-potential change of the second one of the scanning lines, and thus, enables achievement of effects of reducing occurrences of an image retention, and increasing response speeds.

An electrophoretic display according to a third aspect of the invention includes a first substrate and a second substrate configured to include an electrophoretic element interposed therebetween, wherein, on a surface at the electrophoretic element side of the first substrate, the first substrate includes a plurality of scanning lines and a plurality of data lines configured to extend in respective directions so that any one of the scanning lines and any one of the data lines can intersect with each other, a plurality of capacitor lines configured to be formed so as to correspond to the respective scanning lines or the respective data lines, a selection transistor configured to be connected to a first one of the scanning lines and a first one of the data lines, and a pixel electrode configured to be connected to the selection transistor, and a capacitor configured to have one electrode thereof, which is connected to the selection transistor and the pixel electrode, and further, the capacitor is configured to include a first capacitor having the other electrode thereof, which is formed by a second one of the scanning lines, and a second capacitor having the other electrode thereof, which is formed by one of the capacitor lines.

According to this third aspect of the invention, separating a capacitor for each pixel into a first capacitor having the other electrode thereof, which is formed by a second one of the scanning lines, and the second capacitor having the other electrode thereof, which is formed by one of the capacitor lines, enables reduction of a load applied on each of the scanning lines, and brings an advantage of making it possible to perform high-speed operations.

Further, providing the first capacitor having the other electrode that is formed by a second one of the scanning lines causes the electric potential of a pixel electrode to vary in accordance with the electric-potential change of the second one of the scanning lines, and thus, enables achievement of effects of reducing occurrences of an image retention, and increasing response speeds.

In the electrophoretic display according to the first aspect, preferably, the second one of the scanning lines, which forms the other electrode of the capacitor, is one of the scanning lines, which is driven immediately before the first one of the scanning lines, to which the pixel electrode connected to the one electrode of the capacitor corresponds, is driven.

In the electrophoretic display according to the first aspect, since the second one of the scanning lines, which forms the other electrode of the capacitor, is one of the scanning lines, which is driven immediately before the first one of the scanning lines, to which the pixel electrode connected to the one electrode of the capacitor corresponds, is driven, when the second one of the scanning lines is selected and the electric potential thereof is changed, the electric potential of the pixel electrode, which is connected to the second one of the scanning lines via the storage capacitor, varies. Owing to this operation, it is possible to achieve effects of reducing occurrences of an image retention and increasing response speeds.

An electronic device according to a fourth aspect of the invention includes any one of the above-described electrophoretic displays according to the invention.

An electronic device according to this fourth aspect of the invention includes pixel circuits, each of which enables ensuring a large storage capacitance along with maintaining a sufficient aperture ratio by forming a storage capacitor between an electrode and another electrode that is extended from a second one of the scanning lines, which is included in a preceding stage. Therefore, it is possible to provide electronic devices, each being capable of, in addition to realizing high resolutions, suppressing a variation of a field-though voltage to a low level, and reducing non-uniformity of image density. Further, since an electronic device according to this fourth aspect of the invention includes a display, which enables reducing occurrence of an image retention, and performing a high-speed drive, it is possible to obtain electronic devices each having high quality and superior reliability.

BRIEF DESCRIPTION OF THE DRAWINGS

The invention will be described with reference to the accompanying drawings, wherein like numbers reference like elements.

FIG. 9 is a diagram illustrating variations and reduction ratios of respective parasitic capacitances with respect to an existing pixel circuit and a pixel circuit according to a first embodiment of the invention.

DESCRIPTION OF EXEMPLARY EMBODIMENTS

Hereinafter, embodiments according to the invention will be described with reference to drawings. In addition, scales of respective members are appropriately modified so that sizes thereof are large enough to be recognizable.

First Embodiment

Figure 1:
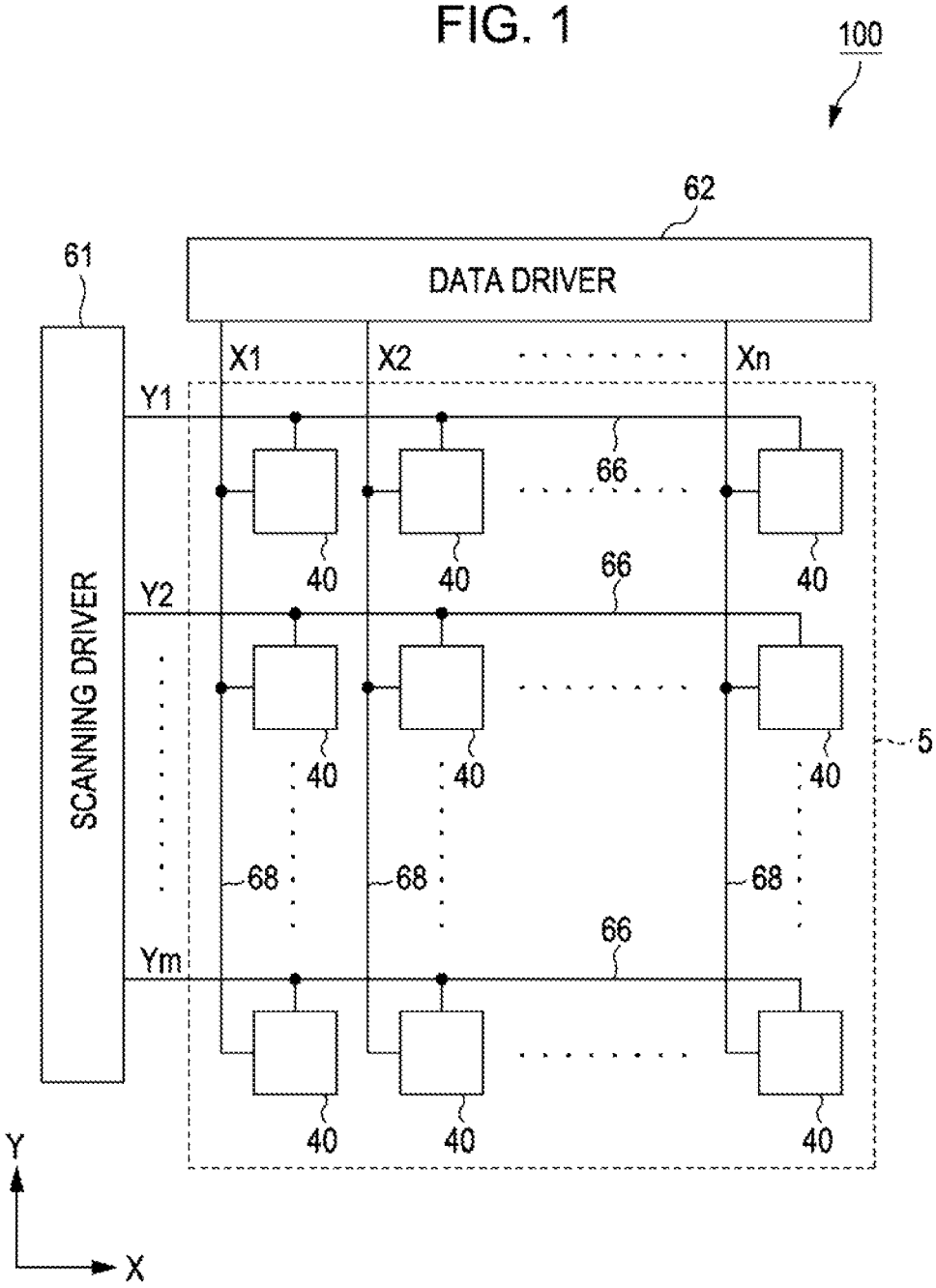
FIG. 1 is a block diagram illustrating a configuration of an electrophoretic display according to a first embodiment of the invention.

FIG. 1 is a block diagram illustrating a configuration of an electrophoretic display 100 according to a first embodiment of the invention. The electrophoretic display 100 is configured to include a plurality of scanning lines 66 (Y1, Y2, . . . , Ym), a scanning driver 61 for sequentially selecting the scanning lines 66, a plurality of data lines 68 (X1, X2 . . . , Xn) each being provided so as to intersect with the scanning lines 66, a data driver 62 for sequentially selecting the data lines 68, a display section 5 including a plurality of pixels 40, which are provided at respective intersection points of the scanning lines 66 and the data lines 68, and are arranged in a matrix shape, and a controller (omitted from illustration) for controlling the scanning driver 61 and the data driver 62.

Figure 2:
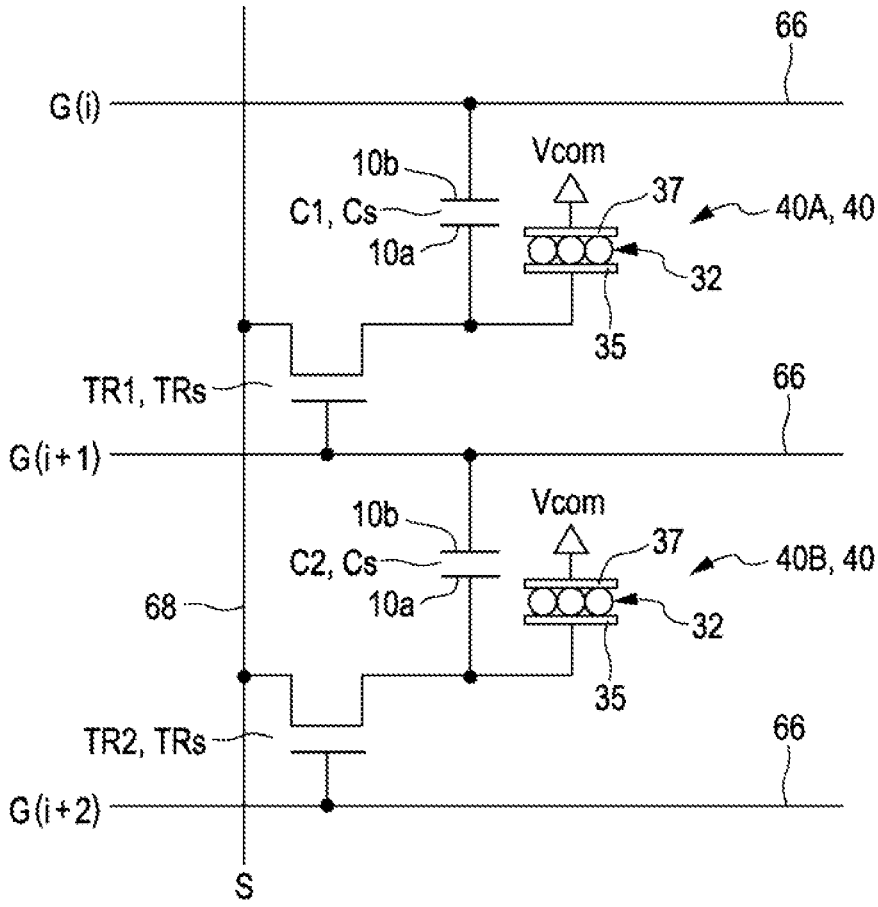
FIG. 2 is a circuit diagram illustrating a typical configuration of a pixel circuit according to a first embodiment of the invention.

FIG. 2 is diagram illustrating a typical configuration of a pixel circuit for each pixel according to a first embodiment of the invention.

As shown in FIG. 2, a pixel circuit for each of the pixels 40 is configured to include an electrophoretic element 32 as an electro-optic material, a storage capacitor Cs (a capacitor) for retaining electric polarization conditions of the electrophoretic element 32, and a selection transistor TRs for performing switching operations to cause the storage capacitor Cs to store electric charges therein. The selection transistor TRs includes a gate to which one of the scanning lines 66 is connected, a source to which one of the data lines 68 is connected, and a drain to which the electrophoretic element 32 and an electrode 10*a* (one electrode) of the storage capacitor Cs are connected.

To any one of the scanning line 66, corresponding to a certain one of the pixels 40, the storage capacitor Cs of a different one of the pixels 40, which is located adjacent to the certain one of the pixels 40 in a row direction, is connected.

For example, an electrode 10*b* (the other electrode) of a storage capacitor C1 (Cs) for a pixel 40A is connected to an i-th line of the scanning lines 66, which is different from an (i+1)th line of the scanning lines 66, which is connected to the selection transistor TRs included in the pixel 40A.

Further, an electrode 10*b* (the other electrode) of a storage capacitor C2 (Cs) for a pixel 40B is connected to an (i+1)th line of the scanning lines 66, which is different from an (i+2)th line of the scanning lines 66, which is connected to the selection transistor TRs included in the pixel 40B.

Such a configuration enables omission of reference electric potential lines for the respective pixels 40.

Next, respective influences on unipolar electro-optic materials and bipolar electro-optic materials, which are exerted by field-through, will be hereinafter described.

Figure 3A:
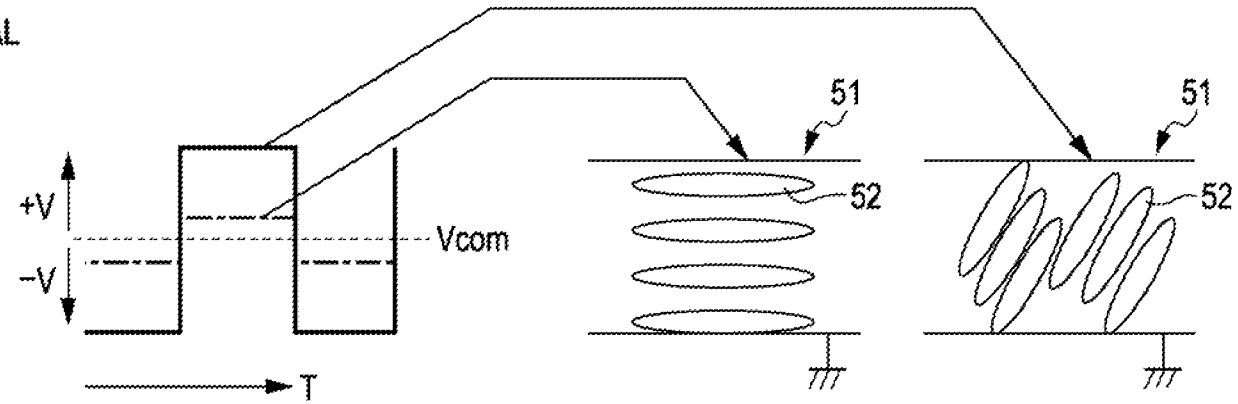
FIG. 3A is a diagram illustrating a relation between a voltage and a display condition with respect to liquid crystal.
Figure 3B:
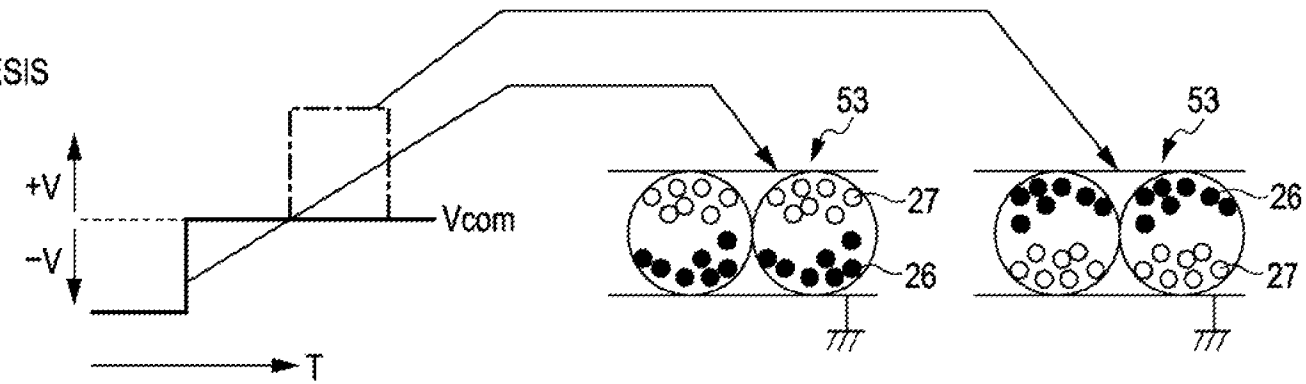
FIG. 3B is a diagram illustrating a relation between a voltage and a display condition with respect to an electrophoretic material.

The influences will be described by using an electrophoretic material as the unipolar electro-optic material and liquid crystal as the electro-optic bipolar material. FIG. 3A shows a relation between a voltage and a display condition with respect to liquid crystal, and FIG. 3B shows a relation between a voltage and a display condition with respect to an electrophoretic material.

For a liquid crystal apparatus 51, as shown in FIG. 3A, a display condition thereof is changed in accordance with the effective value of a voltage applied to liquid crystal. In contrast, for an electrophoretic display 53, as shown in FIG. 3B, a display condition thereof is changed in accordance with the polarities of a voltage applied to an electrophoretic material. In this case, white electric-charge particles 27 are electrically charged so that they are attracted to a negative voltage side, and black electric-charge particles 26 are electrically charged so that they are attracted to a positive voltage side. For the liquid crystal display 51, it is necessary to continue to apply a voltage during a period of time while causing the liquid crystal display 51 to display images, but, in contrast, for the electrophoretic apparatus 53, once writing of an image is completed, afterward, rewriting thereof is unnecessary because of a memory characteristic of the electrophoretic material.

For the electrophoretic display 53, in accordance with the respective polarities of a voltage applied to the electric charge particles 26 and 27, a display condition of the electrophoretic display 53 is changed. In this case, the display condition thereof is changed into a white color condition or a black color condition, and the change is controlled. Further, the control is affected by not only the polarities of an applied voltage, but also the absolute value of the applied voltage and a voltage application time thereof. The most important point in this embodiment is that, as described below, a problem, which is caused from a principle in which the display condition varies in accordance with the polarities of an applied voltage, has been newly discovered, and a solution therefor has been newly invented.

Figure 4:
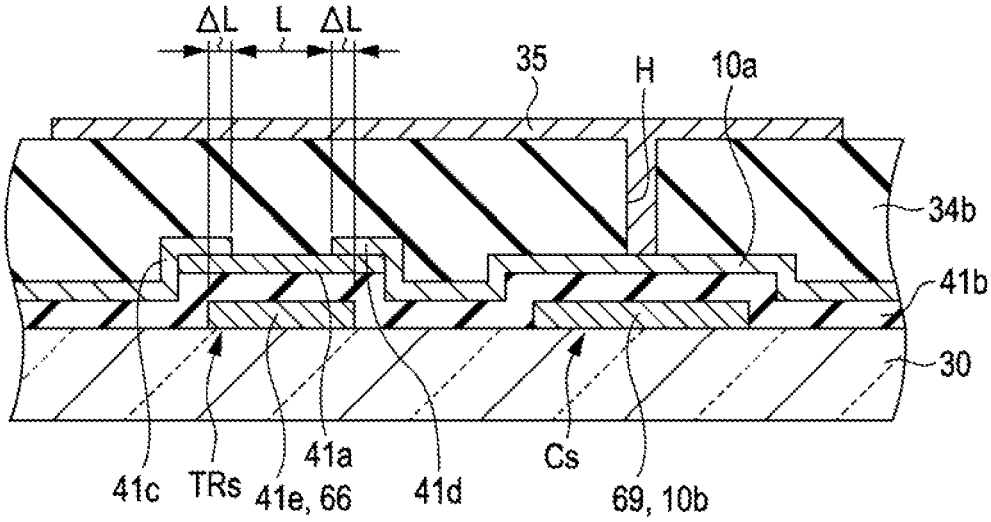
FIG. 4 is a partial cross-sectional view illustrating an existing base plate.

Next, in existing pixel circuits, an influence on an electrophoretic material (electric charge particles), which is exerted by field-through, will be hereinafter described, compared with an influence on liquid crystal, which is exerted by the field-through. FIG. 4 is a partial cross-sectional view illustrating an existing base plate.

As shown in FIG. 4, on a base plate 30, a gate electrode 41*e* (the scanning line 66) and a storage capacitor line 69 (the electrode 10*b*) are formed, and a gate insulating film 41*b* is provided so as to cover these gate electrode 41*e* and storage capacitor line 69. Around a position of the gate insulating film 41*b*, where the gate insulating film 41*b* is overlapped by the gate electrode 41*e*, a semiconductor layer 41*a* is provided, and a drain electrode 41*d* and a source electrode 41*c* are formed so that they partially mount the respective periphery portions of the semiconductor layer 41*a*. an electrode 10*a*, i.e., one electrode of the storage capacitor Cs, is connected to the drain electrode 41*d*, and an electrode 10*b*, i.e., the other electrode thereof, is connected to the storage capacitor line 69.

A pixel electrode 35 that is formed above the selection transistor TRs via an interlayer insulating film 34*b* is connected to the drain electrode 41*d* via a contact hole H, which is formed in the interlayer insulating film 34*b*.

Here, between the gate electrode 41*e* and the drain electrode 41*d* of the selection transistor TRs, there exists a parasitic capacitance (Cgd) that is unavoidable because of a structural reason. This parasitic capacitance is centered on a capacitance occurring between the gate electrode 41*e* and the drain electrode 41*d* in an area overlapped by the gate electrode 41*e* and the drain electrode 41*d*.

As known to those skilled in the art, during a period of time while the selection transistor TRs is in a conductive state, the parasitic capacitance (Cgd) is formed of a capacitance consisting of a capacitance occurring in a portion of the gate insulating film 41*b*, corresponding to a portion approximately half the whole channel area L, and a capacitance occurring in a portion of the gate insulating film 41*b*, corresponding to an area denoted by ΔL (i.e., an area overlapped by the gate electrode 41*e* and the drain electrode 41*d*). In addition, a capacitance occurring in the gate insulating film 41*b* corresponding to a remaining half the channel area L and a capacitance occurring in the gate insulating film 41*b* corresponding to the other area denoted by ΔL are allocated to the source drain electrode 41*c* side, and form a capacitance (Cgs) between the source electrode 41*c* and the gate electrode 41*e*. During a period of time while the selection transistor TRs is in a non-conductive state, a capacitance occurring in the gate insulating film 41*b* corresponding to the area ΔL and a capacitance occurring in a film stack of the semiconductor layer 41*a* form the parasitic capacitance (Cgd). In the field-through described below, the parasitic capacitance (Cgd) occurring during a period of time while the selection transistor TRs is in a conductive state is generally used.

During a gate selection time (during a period of time while a gate voltage is at a high electric potential), a voltage of the data line 68 (an image signal) is written into the storage capacitor Cs via the selection transistor TRs. During a retention time (during a period of time while the electric potential of the gate electrode 41*e* is falling to a low electric potential), the selection transistor TRs is turned off. Here, assuming that an amount of variation of a gate voltage is denoted by Vg, a capacitance of a storage capacitor is denoted by Cs, a capacitance of an electro-optic material is denoted by Ce, and a parasitic capacitance between a gate and a drain is denoted by Cgd, a field-through voltage ΔVg is obtained by using the following formula (1):

$$\Delta Vg = Cgd(Cs+Cgd+Ce)\times Vg \quad (1)$$

An influence exerted by a variation of the field-through voltage ΔVg in a sheet of an object for display in the case of crystal liquid will be hereinafter compared with that in the case of an electrophoretic material.

Figure 5:
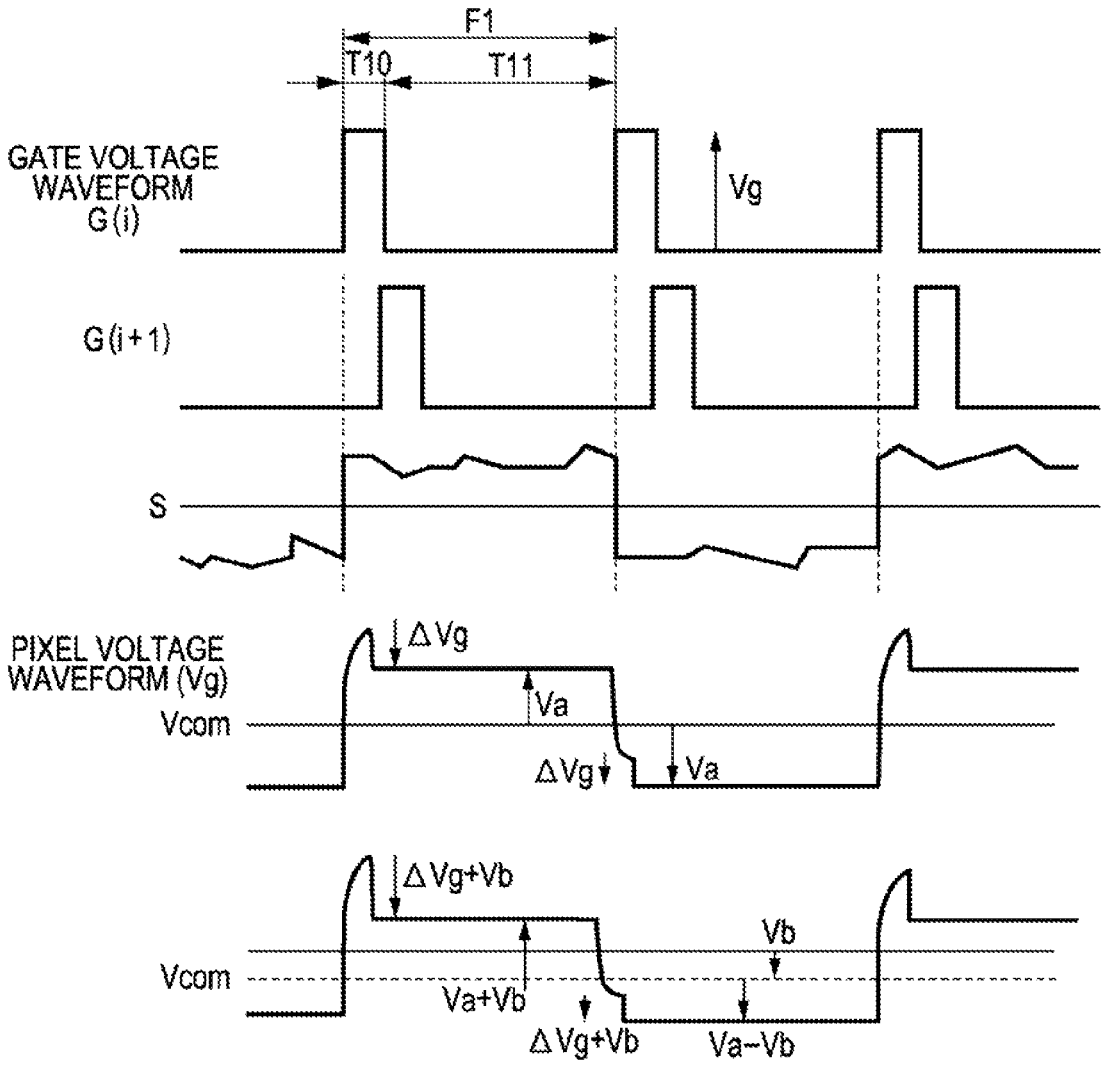
FIG. 5 is diagram illustrating waveforms of driving signals and a voltage applied to liquid crystal in the case of a matrix-type liquid crystal display.

FIG. 5 shows waveforms of driving signals and a voltage applied to liquid crystal in the case of a matrix-type liquid crystal display.

A leakage current occurring during a retention time T11 is ignored. During a gate selection time, a signal voltage of the data line 68 is written into the storage capacitor Cs and the capacitance Ce of the electro-optic material, and at a timing when the gate voltage is turned off to start the retention time, field-through occurs. A common electric potential level Vcom is set in advance so as to be lower than the common voltage level of the signal voltage by a value of the field-through voltage, and an alternating current voltage is applied to liquid crystal. At this time, an effective voltage applied to the liquid crystal is obtained by using the following formula (2).

$$Vlcd = Va \quad (2)$$

In the case where the field-through voltage varies owing to a manufacturing variation and the like, and as a result, is larger than the preceding field-through voltage by Vb, an effective voltage applied to the liquid crystal is obtained by using the following formula (3).

$$\begin{aligned} Vlcd' &= (1/2\times((Va+Vb)(Va+Vb)+(Va-Vb)(Va-Vb)))^{1/2} \quad (3)\\ &= Va(1+(Vb/Va)^2)^{1/2}\\ &= Va+Vb\times Vb/2(Vb<<Va) \end{aligned}$$

Therefore, Vb×Vb×(½) is a variation of the effective voltage. In general, Vb is negligibly smaller than 1V, and thus, this term can be substantially ignored (this term is close to zero). Namely, for a display using a bipolar electro-optic material, variations of respective selection transistors seldom exert an influence on display.

Figure 6:
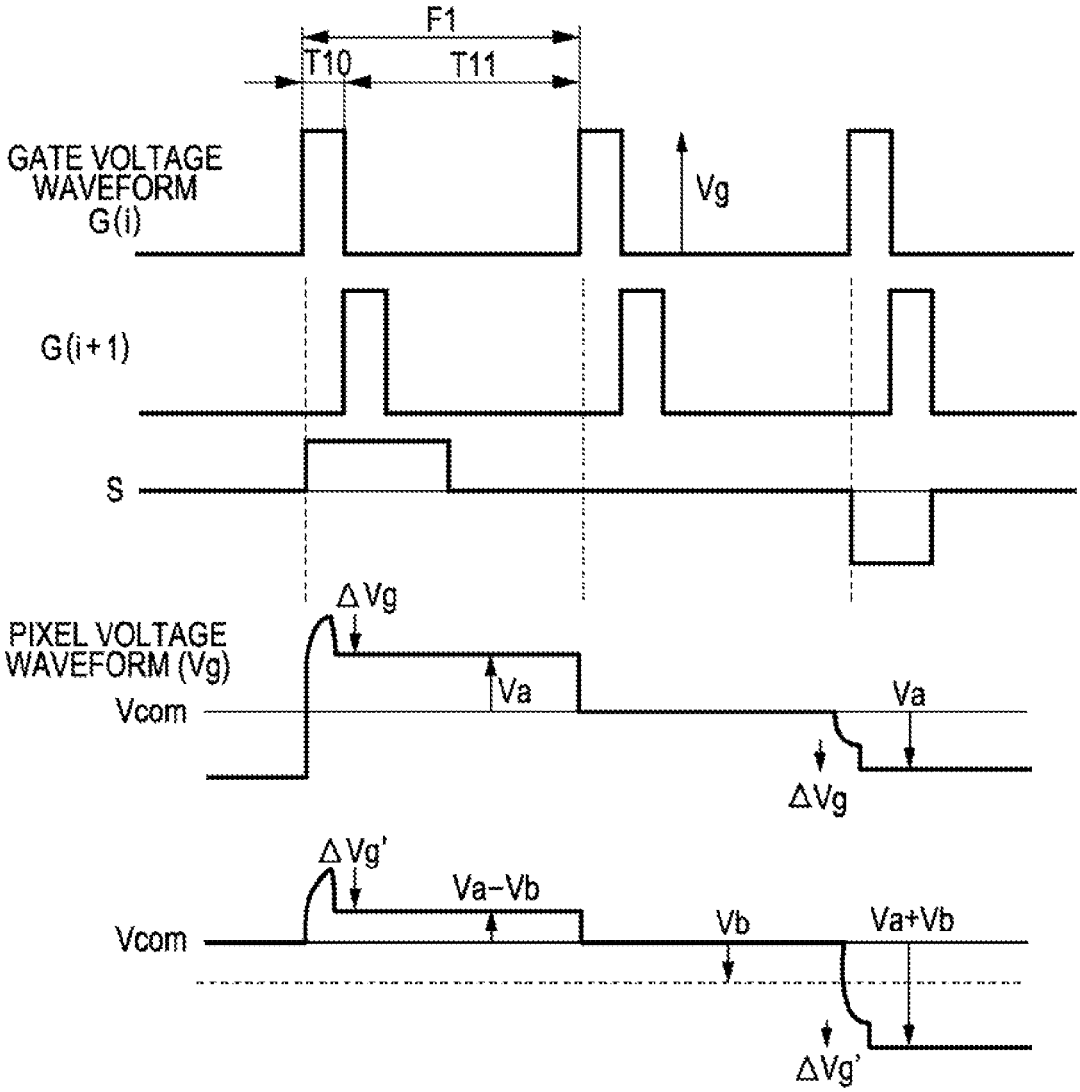
FIG. 6 is diagram illustrating waveforms of driving signals and a voltage applied to an electrophoretic material in the case of a matrix-pixel-type electrophoretic display.

FIG. 6 shows waveforms of driving signals and a voltage applied to an electrophoretic material in the case of a matrix-type electrophoretic display.

Here, a leakage current during a retention time is ignored. During a gate selection time, a voltage signal of the data line 68 is written into the storage capacitor Cs and the capacitance Ce of the electro-optic material, and at a timing when the gate voltage is turned off to start the retention time, field-through occurs. A common electric potential level Vcom is set in advance so as to be lower than a common voltage level of the signal voltage by a value of the field-through voltage, and an alternating current voltage is applied to an electrophoretic material. At this time, an effective alternating current voltage applied to the electrophoretic material is obtained by using the following formula (4).

$$Vce = Va \quad (4)$$

In the case where the field-through voltage varies owing to a manufacturing variation and the like, and as a result, is larger than the preceding field-through voltage by Vb, an effective voltage applied to the liquid crystal is obtained by using the following formula (5).

$$Vce = Va \pm Vb \quad (5)$$

It can be understood from the above-described formula (5) that a voltage twice the field-through voltage Vb results in a variation of the effective voltage applied to the electrophoretic material.

Further, as a result, it can be also understood that, in the case of the unipolar electro-optic materials, the variation of the effective voltage applied to the electrophoretic material, which is not a problem in the case of the liquid crystal, is a significant problem. Further, the variation of the effective voltage applied to the electrophoretic material causes non-uniformity of image density (unevenness of a displayed image) when displaying intermediate gray-scale images. This problem is more significant in the case where, for the purpose of realization of displaying high-resolution images or color images, the size of a pixel becomes small, and, owing thereto, it is difficult to sufficiently ensure the capacitance of a storage capacitor. In fact, in a prototype (Cs=400 fF, Cgd=60 fF) using an amorphous TFT of 385 dpi, the non-uniformity makes a halftone image with white and black colors alone.

In order to eliminate non-uniformity of image density, it is effective to reduce an amount of variation of the field-through voltage. In general, the parasitic capacitance Cgd is negligibly small compared with both of the capacitance Cs of a storage capacitor and the capacitance Ce of an electro-optic material. Therefore, in order to reduce the variation of the field-through voltage, two methods conceived on the basis of the formula (1) are; increasing the capacitance Cs of the storage capacitor; and reducing the parasitic capacitance Cgd. Here, changing the capacitance Ce of the electro-optic material is not considered because the capacitance Ce is specific to the material and constant.) In order to increase the capacitance Cs of the storage capacitor, it is effective to produce a TFT substrate structure by using a manufacturing method described below. In order to reduce the parasitic capacitance Cgd, it is effective to use the selection transistor TRs with high mobility so as to reduce the size of the selection transistor TRs.

Figure 16A:
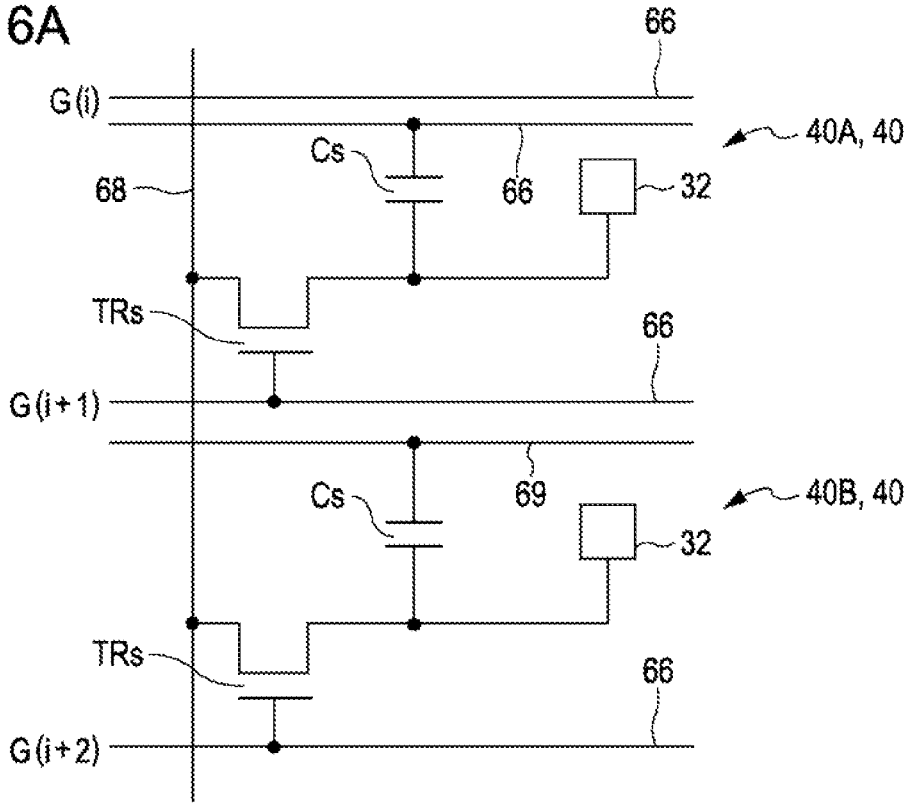
FIGS. 16A and 16B are diagram illustrations an existing pixel circuit.
Figure 17:
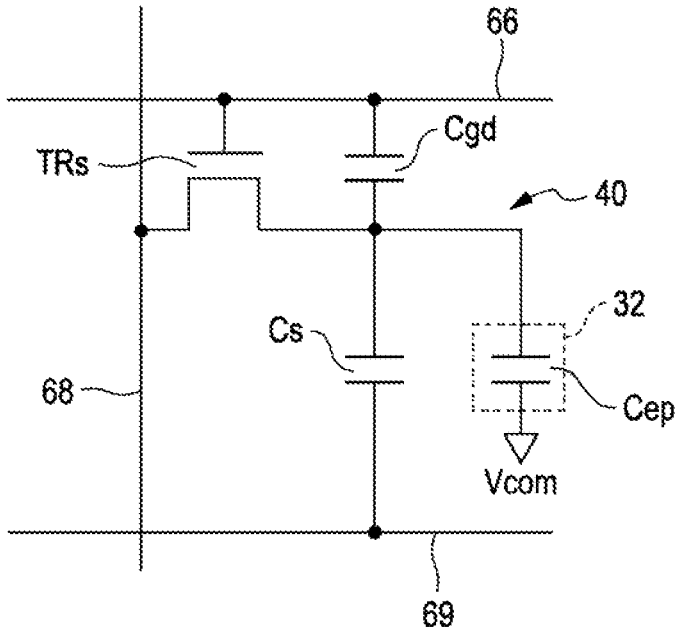
FIG. 17 is a diagram illustrating an existing configuration of a pixel.

Here, FIGS. 16A and 17 are diagrams each illustrating a circuit of an existing electrophoretic display.

Figure 16B:
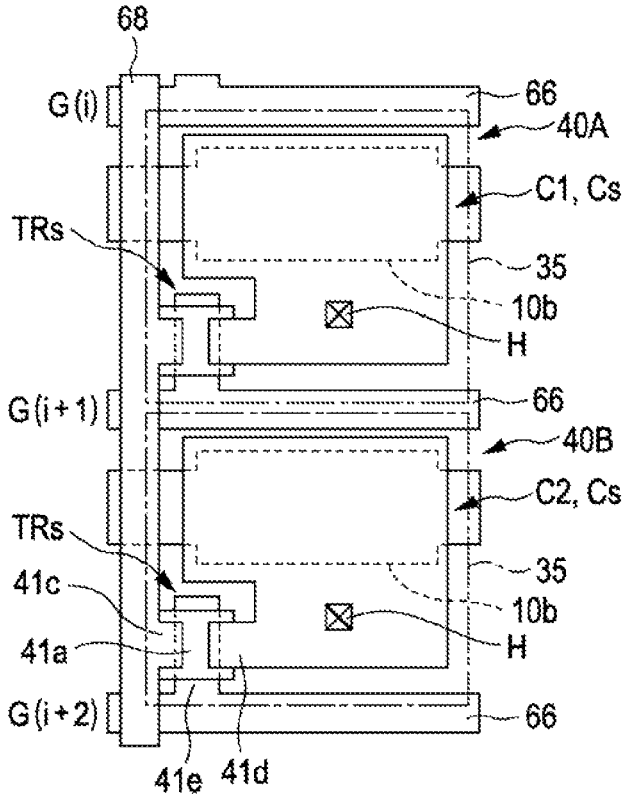

FIG. 16A is a diagram illustrating a circuit of an existing pixel, and FIG. 16B is a plan view illustrating a configuration of a pixel.

As shown in FIGS. 16A and 16B, a pixel circuit is configured to include an electrophoretic element 32 as an electro-optic material, a storage capacitor Cs for retaining electric polarization conditions of the electrophoretic element 32, and a selection transistor TRs for performing switching operations to cause the storage capacitor Cs to store electric charges therein. The selection transistor TRs has a gate electrode 41*e* to which one of the scanning lines 66 is connected, a source electrode 41*c* to which one of the data lines 68 is connected, and a drain electrode 41*d* to which the electrophoretic element 32 and one electrode of the storage capacitor Cs are connected. The other electrode of the storage capacitor Cs is connected to one of the storage capacitor lines 69, which extends in parallel with one of the scanning lines 66.

As described above, since, in order to eliminate non-uniformity of image density, it is effective to reduce an amount of variation of a field-through voltage, a configuration, in which, most of an area laid out for each pixel is allocated to an area for the storage capacitor Cs, is well known to those skilled in the art. However, along with a higher resolution of a display screen, it is necessary to reduce an occupation ratio of an area of a storage capacitor relative to an area of a pixel. Reduction of an area for driving elements is restricted by a design rule. That is, particularly in high-resolution displays, a ratio of the capacitance of the storage capacitor Cs relative to the capacitance Cep of the electrophoretic element, as well as a ratio of the capacitance of the storage capacitor Cs relative to the capacitance Cgd between a gate electrode and a drain electrode, becomes small, thus, this trend increases an influence exerted by the variation of the field-through voltage, and as a result, the possibility of occurrences of the non-uniformity of image density becomes higher.

Therefore, in this embodiment according to the invention, by causing a storage capacitor line and the scanning line 66 of a preceding stage to be common to each other, it is possible to ensure a large capacitance of the storage capacitor Cs, and thereby, reduce an amount of variation of the field-through voltage.

Hereinafter, an outline of a configuration of a pixel according to this embodiment will be described.

In this embodiment, there exist a pair of electrodes forming the storage capacitor Cs, one electrode being electrically connected to a drain electrode, the other electrode being electrically connected to the scanning line 66 of a preceding stage.

Figure 7:
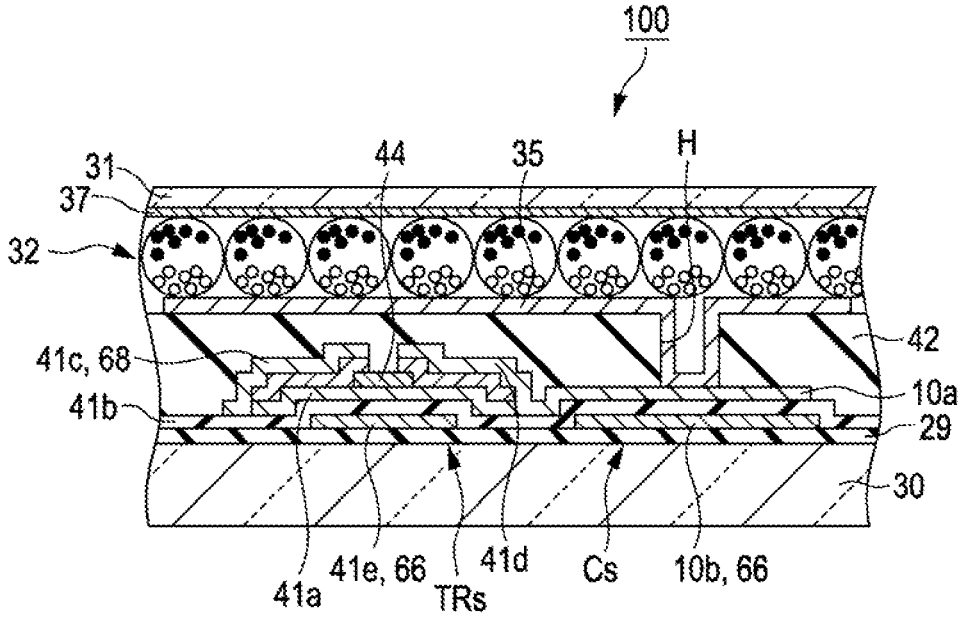
FIG. 7 is a partial cross-sectional view illustration an outline of a configuration of an electrophoretic apparatus according to a first embodiment of the invention.

FIG. 7 is a partial cross-sectional view illustrating an outline of a configuration of the electrophoretic display 100.

As shown in FIG. 7, the electrophoretic display 100 according to this embodiment includes the capsule-type electrophoretic elements 32 interposed between a base plate 30 (a first substrate) and an opposite plate 31 (a second substrate). On a surface at the electrophoretic element 32 side of the base plate 30, the plurality of scanning lines 66 and the plurality of data lines 68, which extend in respective directions so that they can intersect with each other, are formed. Further, the base plate 30 is configured to include the selection transistor TRs, which is connected to one of the scanning lines 66 and one of the data lines 68, a pixel electrode 35, which is connected to the selection transistor TRs, and the storage capacitor Cs (capacitor).

Figure 8A:
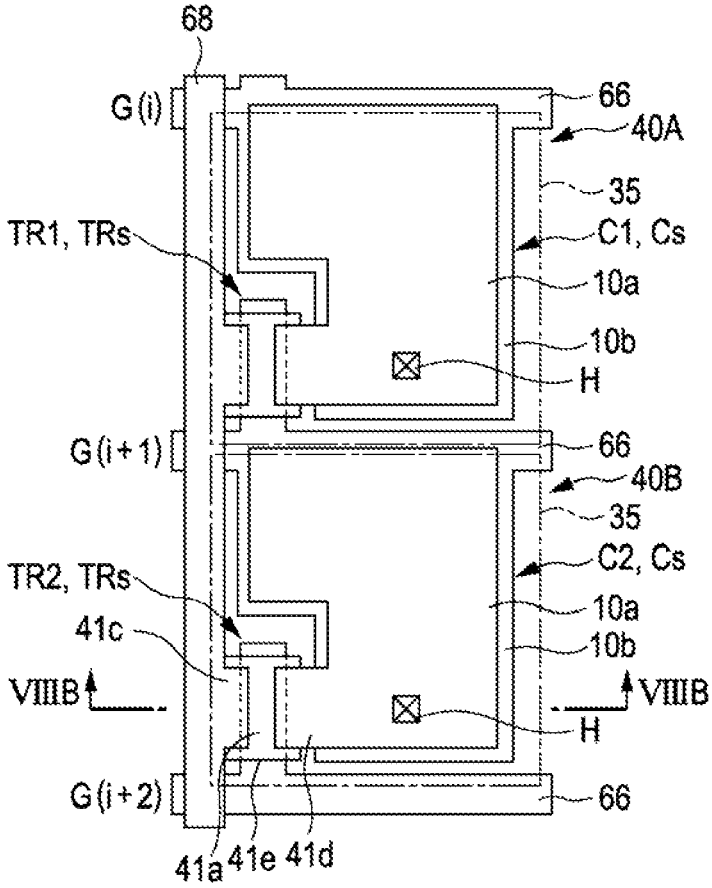
FIG. 8A is a diagram illustrating a configuration of a pixel circuit for an electrophoretic display according to a first embodiment of the invention.
Figure 8B:
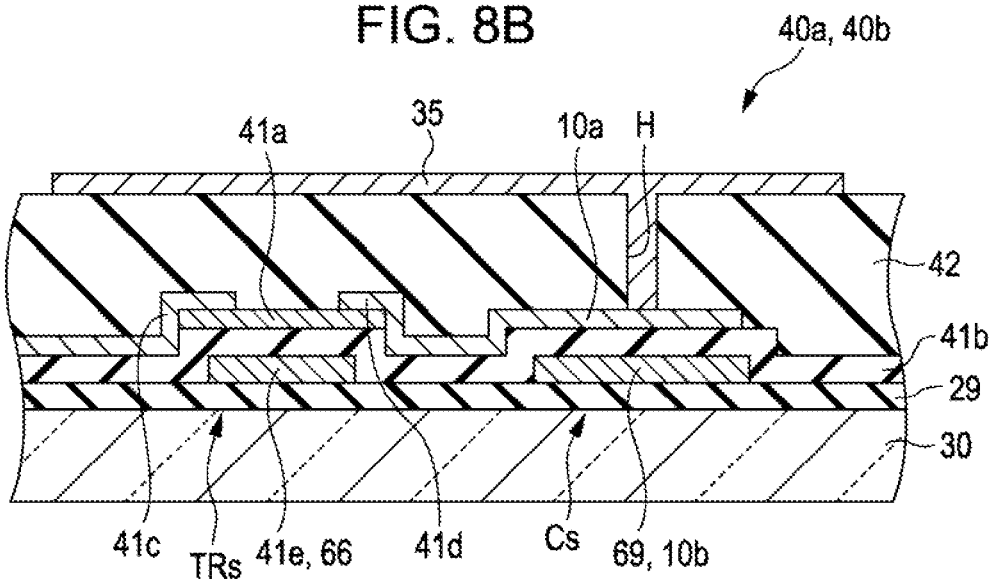
FIG. 8B is a cross-sectional view taken along the VIIIB-VIIIB line of FIG. 8A.

FIG. 8A is a plan view illustrating configurations of the pixels 40A and 40B included in the electrophoretic display 100, and FIG. 8B is a cross-sectional view taken along the line VIIIB-VIIIB of FIG. 8A.

As shown in FIG. 8A, in the respective pixels 40A and 40B, selection transistors TR1 (TRs) and TR2 (TRs), the pixel electrodes 35 and 35, and storage capacitors C1 (Cs) and C2 (Cs) are formed, and further, although omitted from illustration in FIG. 8A, in the respective pixels 40A and 40B, the electrophoretic elements 32 and 32, and common electrodes 37 and 37 are formed.

The selection transistors TR1 and TR2 are each configured by an negative metal oxide semiconductor TFT transistor (N-MOS).

The electrophoretic element 32 is interposed between the pixel electrode 35 and the common electrode 37.

The storage capacitors C1 and C2 are formed on the base plate 30, which will be described below, and each of the storage capacitors C1 and C2 has a pair of electrodes 10*a* and 10*b* which are allocated so as to be opposite each other via a dielectric film.

Further, the storage capacitors C1 and C2 are electrically charged by respective image signal voltages that are written via the corresponding selection transistors TR1 and TR2. As will be described hereinafter in detail, the storage capacitors C1 and C2 in this embodiment are each configured to form a Cs-on-gate structure, in which the storage capacitor Cs for a certain one of the pixels is formed by utilizing one of the scanning lines 66, which corresponds to a different one of the pixels, which is located adjacent to the certain one of the pixels.

The selection transistor TR1 of the pixel 40A has three electrodes, a first one being the gate electrode 41*e* to which an (i+1)th line of the scanning lines 66 is connected, a second one being the source electrode 41*c* to which one of the data lines 68 is connected, a third one being the drain electrode 41*d* to which the electrode 10*a*, i.e., one electrode of the storage capacitor C1, and the pixel electrode 35 are connected. Further, the electrode 10*b*, i.e., the other electrode of the storage capacitor C1 is connected to an i-th line of the scanning lines 66.

The selection transistor TR2 of the pixel 40B has three electrodes, a first one being the gate electrode 41*e* to which an (i+2)th line of the scanning lines 66 is connected, a second one being the source electrode 41*c* to which one of the data lines 68 is connected, a third one being the drain electrode 41*d* to which the electrode 10*a*, i.e., one electrode of the storage capacitor C2, and the pixel electrode 35 are connected. Further, the electrode 10*b*, i.e., the other electrode of the storage capacitor C2, is connected to an (i+1)th line of the scanning lines 66.

The storage capacitors C1 and C2 is each configured to form a capacitance by using a pair of the electrodes 10*a* and 10*b*, and are each formed so as to have a space, which approximately occupies an area of a portion of a pixel region, other than a portion thereof in which the selection transistor TRs is formed. The electrode 10*b* of the storage capacitor C1 is formed by a portion resulting from extension of the i-th line of the scanning lines 66 to the inside of the pixel 40A, and the electrode 10*b* of the storage capacitor C2 is formed by a portion resulting from extension of the (i+1)th line of the scanning lines 66 to the inside of the pixel 40B. That is, as the electrodes 10*b* and 10*b* of the storage capacitors C1 and C2 for the respective pixels 40A and 40B, the corresponding scanning lines 66 of preceding stages are utilized.

As shown in FIG. 8B, on the base plate 30 made of a glass substrate, the gate electrode 41*e* made of an aluminum (Al) material of 300 nm thickness, the scanning line 66, and the electrode 10*b*, i.e., the other electrode of the storage capacitor C2 (Cs) are provided. So as to cover the gate electrode 41*e*, the scanning line 66, and the electrode 10*b*, i.e., the other electrode of the storage capacitor C2 (Cs), the gate insulating film 41*b*, which is made of an oxide silicon material or a silicon nitride material, is formed on the whole of the substrate.

On this gate insulating film 41*b*, the source electrode 41*c* and the drain electrode 41*d*, each having the thickness of 300 nm, are each provided so as to partially overlap the gate electrode 41*e* and the semiconductor layer 41*a*. The source electrode 41*c* and the drain electrode 41*d* are each formed so as to partially mount the semiconductor layer 41*a*. Further, the electrode 10*a*, i.e., one electrode of the storage capacitor Cs, which is similarly made of an aluminum material of 300 nm thickness, is formed over the electrode 10*b*, i.e., the other electrode of the storage capacitor C2 (Cs). This electrode 10*a*, i.e., one electrode of the storage capacitor C2 (Cs), is connected to the drain electrode 41*d*.

So as to cover the source electrode 41*c*, the drain electrode 41*d* and the electrode 10*a*, i.e., one electrode of the storage capacitor C2 (Cs), a protection film 42, which consists of an oxide silicon film having the thickness of 100 nm and a silicon nitride film having the thickness of 300 nm, is provided on the second insulating film 41*b*. This protection film 42 functions as a planarizing film.

On the protection film 42, the pixel electrode 35 made of an ITO material having the thickness of 50 nm is formed. This pixel electrode 35 is connected to a lower layer, i.e., the drain electrode 41*d*, via a contact hole passing through the protection film 42.

Meanwhile, on the opposite plate 31, the common electrode 37 (an opposite electrode), which is made of an ITO material of 100 nm thickness and is formed on a transparent substrate made of a PET material, is provided. Here, it is to be noted that, in the case of the above-described configuration of the base plate 30, the film thickness of the insulating film of the storage capacitor Cs is thin, such as 100 nm.

Next, effects of this embodiment will be hereinafter described with reference to FIGS. 9 and 10.

Figure 10:
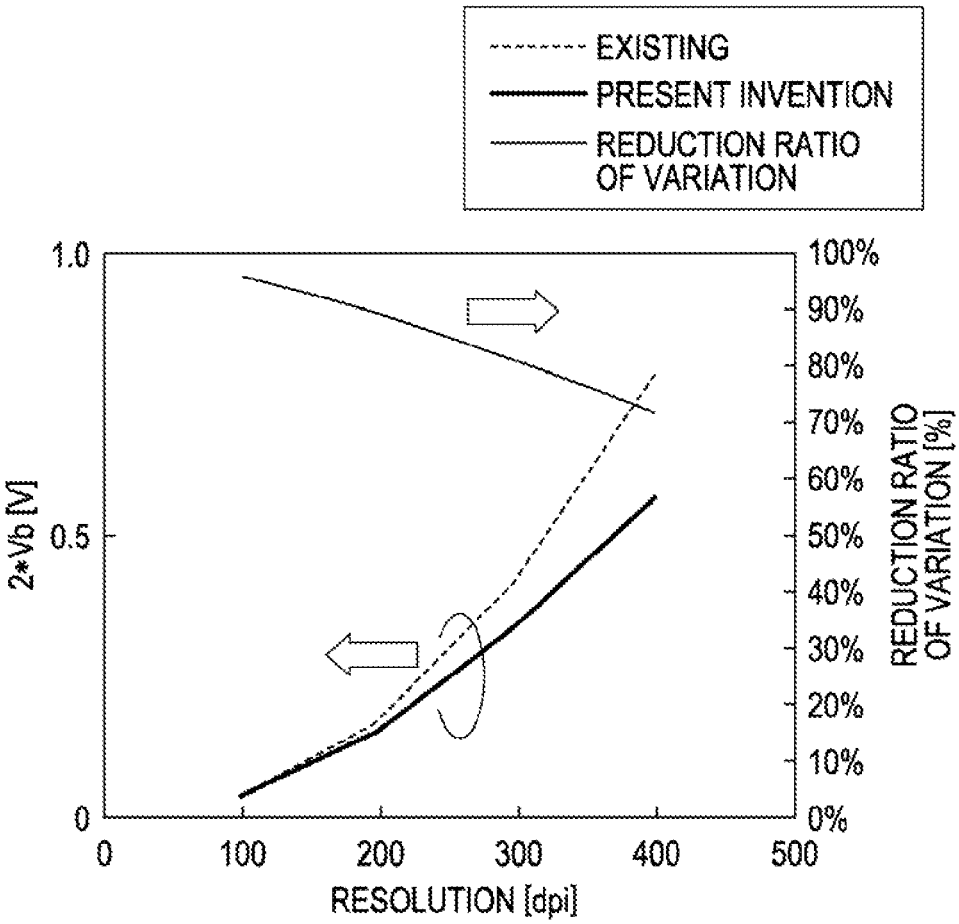
FIG. 10 is a graph illustrating variations and reduction ratios of respective parasitic capacitances with respect to an existing pixel circuit and a pixel circuit according to a first embodiment of the invention.

In FIGS. 9 and 10, for an existing pixel circuit, and a pixel circuit to which aspects of the invention are applied, the variation of the effective alternating current voltage, i.e., 2 Vb, and a variation reduction ratio at a time when a ratio of the variation of the parasitic capacitance ΔCgs relative to the parasitic capacitance Cgs is equal to 30%, is shown. In FIG. 10, a left vertical axis denotes the variation of the effective alternating current voltage, i.e., 2 Vb, a right vertical axis denotes the variation reduction ratio, and a horizontal axis denotes a resolution area (dpi).

As a result of this comparison, it can be understood that the variation of the effective alternating current voltage, i.e., 2 Vb in the case of the pixel circuit according to aspects of the invention is reduced to a greater extent, compared with that in the case of the existing pixel circuit. Particularly, in a high resolution area including resolutions more than or equal to 200 dpi, applying aspects of the invention to the pixel circuit is so effective that the corresponding variation reduction ratios become more than or equal to 10%. This effectiveness appears more significantly in a higher resolution area.

Specifically, it can be understood that, as a result, an effect in which, when the resolution is 300 dpi, the variation of the effective alternating current voltage is reduced by approximately 0.1 V, i.e., approximately 20%, and when the resolution is 400 dpi, the variation of the effective alternating current voltage is reduced by approximately 0.2 V, i.e., approximately 30%, can be brought. Owing to such a method, it is possible to reduce variations of respective gray scales of displayed images.

An area for each pixel becomes smaller along with increasing resolution. Here, assuming that the size of a transistor is not affected by any changes of a resolution, along with increasing resolution, the storage capacitor and the capacitance Cep of the electrophoretic element 32 for each pixel become smaller. As a result, a ratio of the capacitance Cgs between a gate electrode and a source electrode relative to the storage capacitor Cs, as well as a ratio of the capacitance Cgs relative to the capacitance Cep of the electrophoretic element 32, becomes larger, and thus, the variation of the effective alternating current voltage becomes larger.

In order to overcome the problem described above, by applying aspects of the invention to increase the capacitance of the storage capacitor Cs, it is possible to reduce a ratio of the parasitic capacitance Cgs relative to the capacitance of the storage capacitor Cs, and make the variation of the effective alternating current voltage be small. Application of aspects of the invention may not be so effective in a low-resolution display with a large storage capacitor Cs, but is effective particularly in a high-resolution display. In particular, in the case where the pixel electrode 35 is formed of dots whose density is more than or equal to 200 dpi, applying aspects of the invention is effective. From a viewpoint of a capacitance ratio, in displays, for each of which a ratio of an amount of the parasitic capacitance Cgs associated with each selection transistor relative to an amount of capacitance of the storage capacitor Cs is less than or equal to 1%, applying aspects of the invention brings a significant effect.

As disclosed in the invention, a method of actively forming a capacitance between the electrode 10*a* and the electrode 10*b* that is extended from the scanning line 66 of a preceding stage brings a large effect on realization of a high-speed response when driving the photoelectric elements 32, and countermeasure for occurrences of an image retention. In a pixel circuit connected to a certain line of the scanning lines 66, owing to sequential selection processing, when a voltage of the scanning line 66 of a preceding stage is changed, a phenomenon of a flash distortion of an electric potential of the pixel electrode 35 due to a capacitance coupling via the storage capacitor Cs occurs. Owing to this phenomenon, the electrophoretic particles 32 having been absorbed to around the pixel electrode 35 area by an electric image force are ripped apart from the wall surfaces of the respective microcapsules 20, and are in a condition in which they are likely to be electrophoresed.

Subsequently, when the certain line of the scanning lines 66 is selected, and any voltage is supplied to the pixel electrode 35, an effect, in which the electrophoretic particles 32 respond thereto in a high-speed manner, and occurrences of the image retention are reduced, can be obtained.

Next, a manufacturing method of the electrophoretic display 100 according to this embodiment will be hereinafter described.

FIG. 11 is a partial cross-sectional view illustrating a manufacturing procedure of the electrophoretic display 100.

Figure 11A:
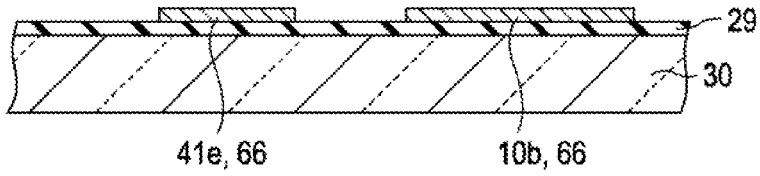
FIGS. 11A to 11F are partial cross-sectional views illustrating respective manufacturing processes for an electrophoretic display according to a first embodiment of the invention.

As shown in FIG. 11A, on a substrate material 30A made of quartz of 0.6 mm thickness, a base insulating film 29 made of an $SiO_2$ film is formed.

Next, by depositing tantalum (Ta) or chromium on the whole surface of a substrate by using a physical vapor phase depositing method, a thin metallic film of 100 to 300 nm thickness is formed, and by using a photo-edging method, the gate electrode 41*e*, the scanning lines 66, and the electrode 10*b*, i.e., the other electrode of the storage capacitor Cs are formed.

In this case, in order to reduce electric influences on the electrophoretic elements 32, which will be formed later, exerted by the gate electrode 41*e* and other wirings, preferably, a wiring width of each of the gate electrode 41*e* and other wirings is made as thin as possible. Specifically, the wiring width thereof is preferred to be less than or equal to 4 μm.

Figure 11B:
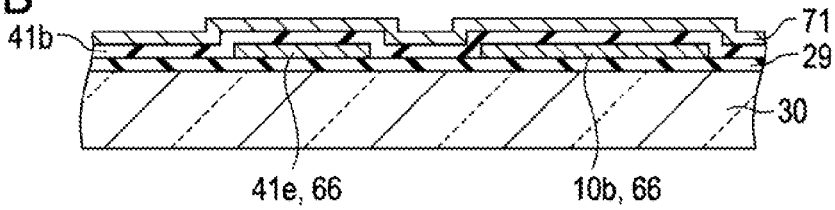

As shown in FIG. 11B, so as to cover the gate electrode 41, the scanning lines 66 and the electrode 10*b*, on the substrate, a silicon nitride hydroxide film (SiNx) is deposited by using a plasma CVD method, and monosilane (SiH4) and ammonia are deposited as raw-material gases by using a plasma-enhanced chemical vapor deposition (PECVD) method.

In such a manner, the gate insulating film 41*b* of 300 nm thickness is formed.

Next, on the gate insulating film 41*b*, by handling monosilane and hydrogen as raw-material gases, a true amorphous silicon film 71 of approximately 50 nm to 150 nm is deposited by using the PECVD method. This layer will be a channel of the selection transistor TRs later.

Figure 11C:
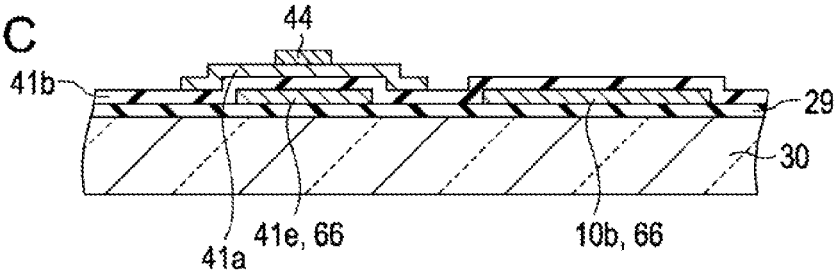

As shown in FIG. 11C, a silicon nitride film, which will be an etching stopper 44, is deposited, and is processed into an island shape by using a photolithographic method. This silicon nitride film is formed to protect a silicon layer of a channel portion when performing an etching process on an n-type amorphous silicon film, which will be source and drain areas of the selection transistor TRs later, but the silicon film can be omitted.

Figure 11D:
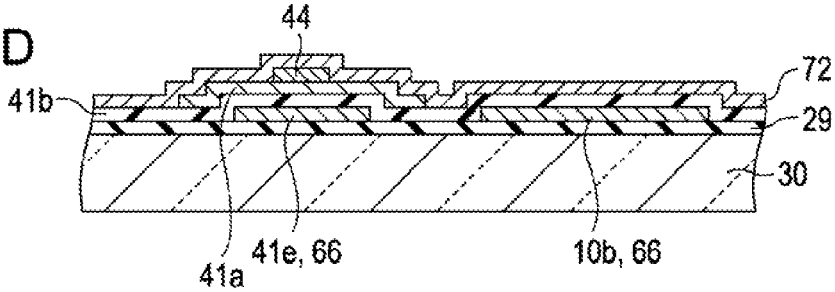

As shown in FIG. 11D, an n-type amorphous silicon layer 72 including phosphorus of $1\times10^{20}$ $cm^{-3}$ is deposited by using the PECVD method to form source and drain areas.

Figure 11E:
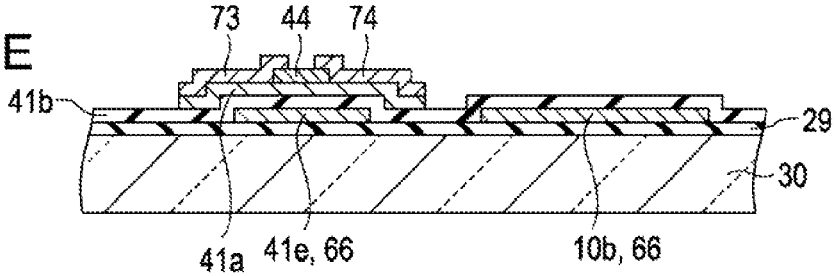

As shown in FIG. 11E, by using a photolithographic method, a true amorphous silicon layer 73 and an n-type amorphous silicon layer 74 are simultaneously processed into island shapes, respectively.

Figure 11F:
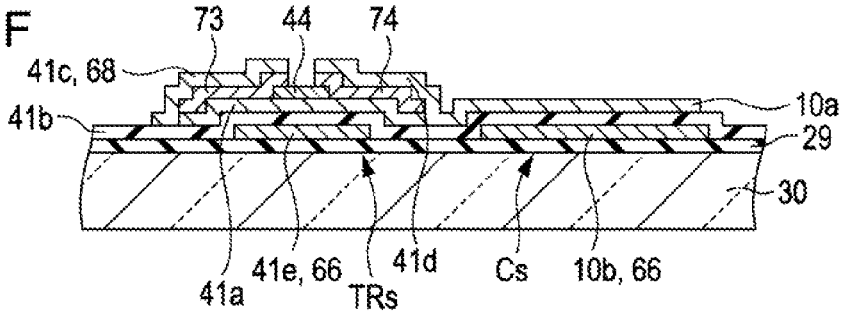

As shown in FIG. 11F, a metallic material, such as an aluminum (Al) material, is deposited by using a sputter method, and a patterning process on the resultant metallic film is performed by using the photolithographic method, so that the source electrode 41*e*, the drain electrode 41*d* and the data lines 68 are formed, and the transistor TRs and the storage capacitor Cs are obtained.

Figure 12G:
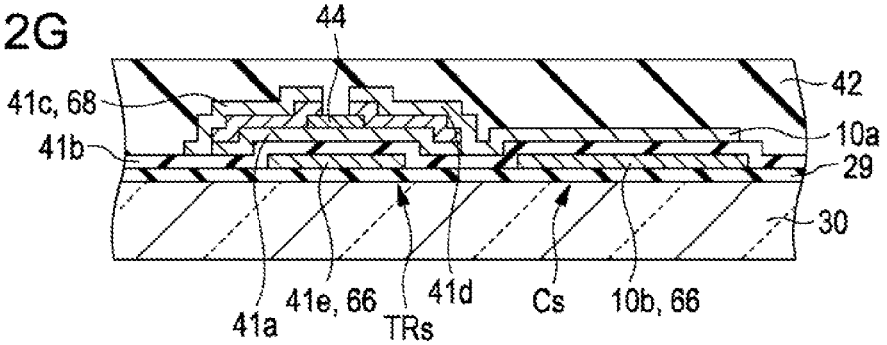
FIGS. 12G to 12J are partial cross-sectional views illustrating respective manufacturing processes for an electrophoretic display according to a first embodiment of the invention.

As shown in FIG. 12G, so as to cover the source electrode 41*c*, the drain electrode 41*d* and the data lines 68, a silicon nitride hydroxide film is deposited by using the plasma CVD method, so that the protection film 42 is formed as a planarizing film.

Figure 12H:
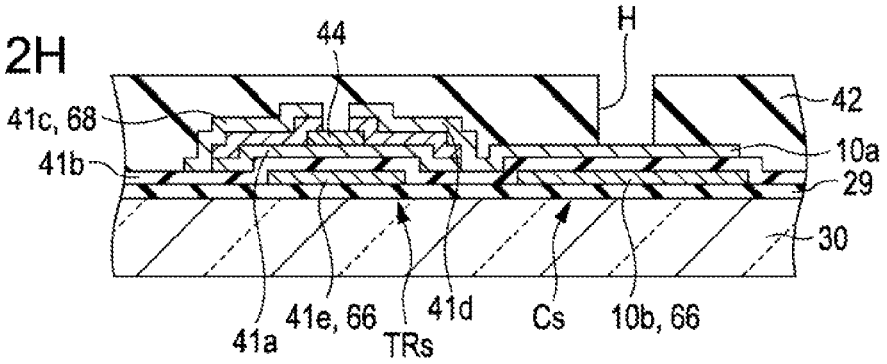

As shown in FIG. 12H, a contact hole used for a connection to the pixel electrode 35, which will be formed in the following process, is formed by using the photolithographic method.

Figure 12I:
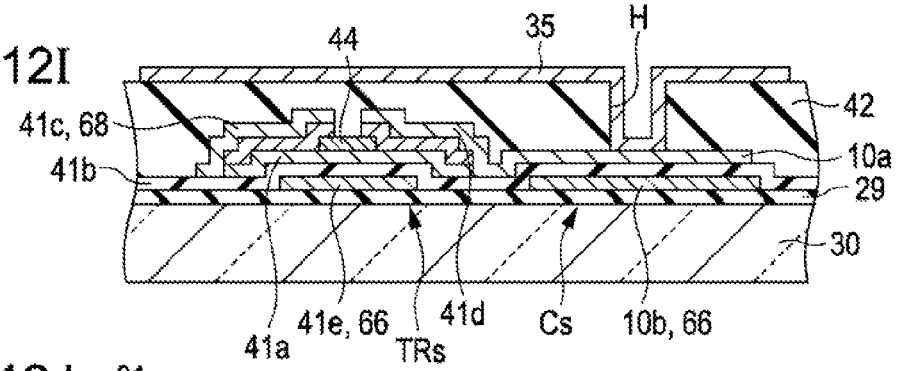

As shown in FIG. 12I, a transparent electrode, which is made of an ITO material and the like, is coated by using the sputter method, and is processed into the shape of the pixel electrode 35 by using the photolithographic method. In this embodiment, within a pixel area, the pixel electrodes are formed so as to have a dot density of more than or equal to 200 dpi.

Figure 12J:
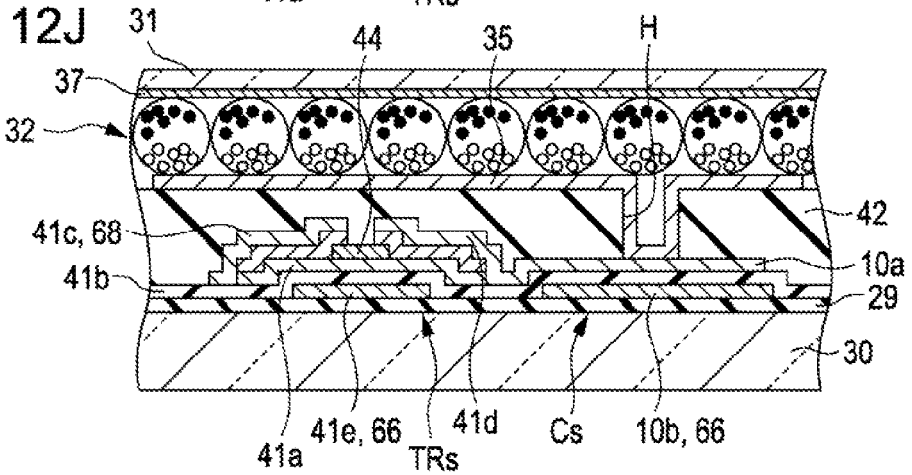

As shown in FIG. 12J, by bonding an electrophoretic sheet 31 including the common electrode 37 and an electrophoretic layer 32 consisting of a plurality of microcapsules on the opposite plate 31 onto the pixel electrode 35 of the base plate 30, the electrophoretic display 100 according to this embodiment is brought to a completion.

In the manufacturing method according to this embodiment, since the electrode 10*b*, i.e., the other electrode of the storage capacitor Cs corresponding to each of the pixels 40 is connected to the scanning line 66 of a preceding stage, it is unnecessary to form storage capacitor lines, and this unnecessity of forming the storage capacitor lines leads to an easy manufacturing method.

As described above, in this embodiment, by forming the storage capacitor Cs between the electrode 10*a* and the electrode 10*b* that is extended from the scanning line 66 of a preceding stage, a pixel circuit, which enables ensuring a large storage capacitance along with maintaining a sufficient aperture ratio, has been realized.

Further, such a pixel circuit has brought achievement of the electrophoretic display 100, which is capable of, in addition to realizing high resolutions, suppressing a variation of a field-though voltage to a low level, reducing occurrences of an image retention, and performing operations at a high speed.

Second Embodiment

Next, a second embodiment according to the invention will be hereinafter described.

Figure 13:
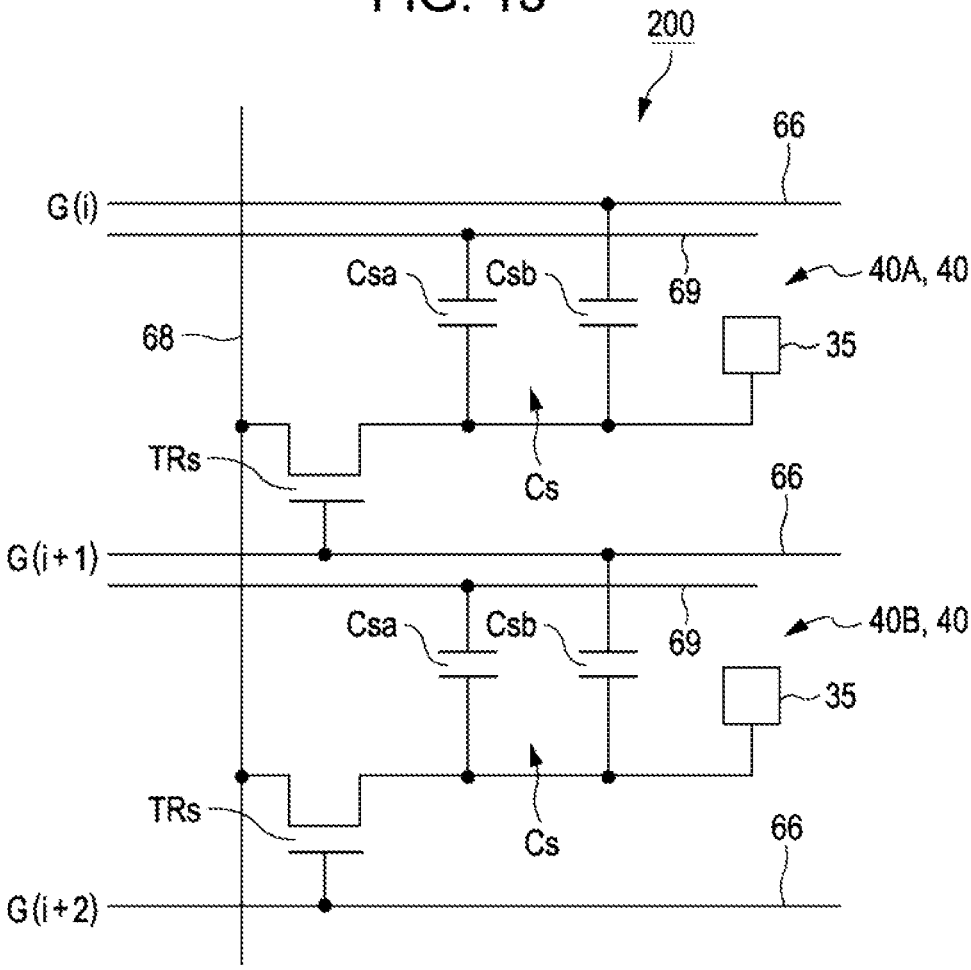
FIG. 13 is a diagram illustrating a detailed configuration of a pixel circuit according to a second embodiment of the invention.
Figure 14:
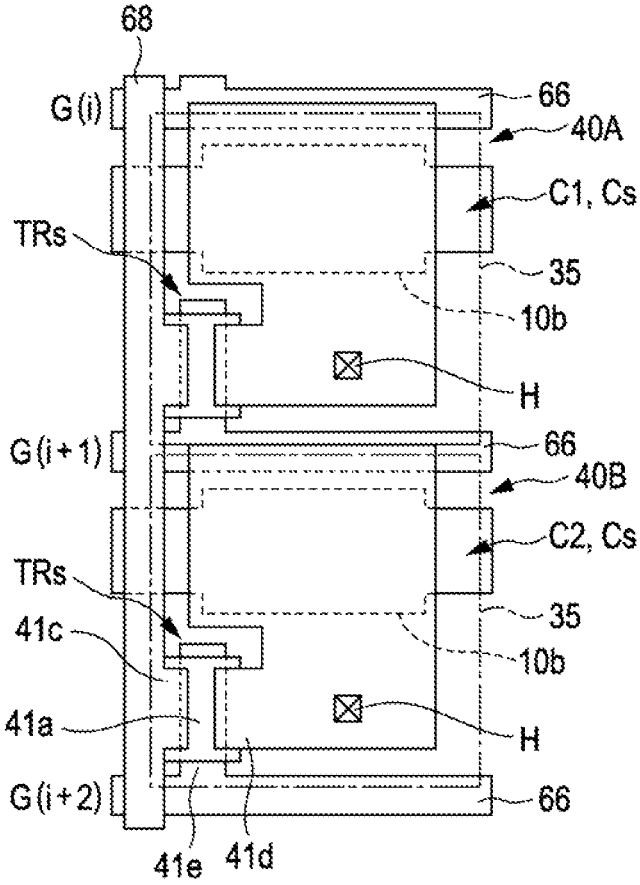
FIG. 14 is a plan view illustrating layouts of respective pixels included in an electrophoretic display according to a second embodiment of the invention.
Figure 15A:
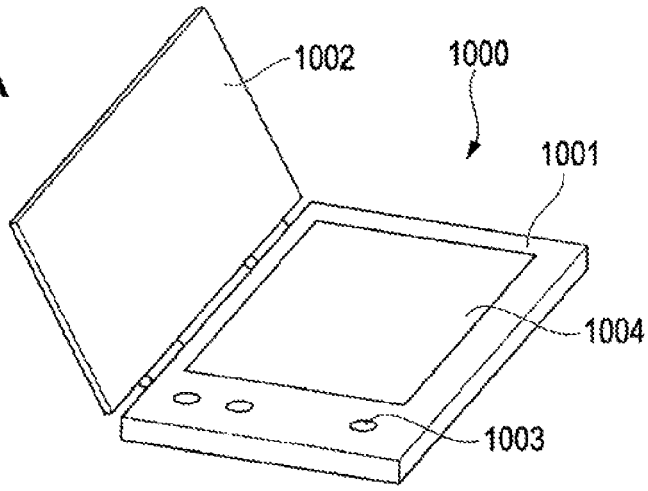
FIGS. 15A, 15B and 15C are diagrams each illustrating an example of an electronic device to which an electrophoretic display according to some aspects of the invention is applied.
Figure 15B:
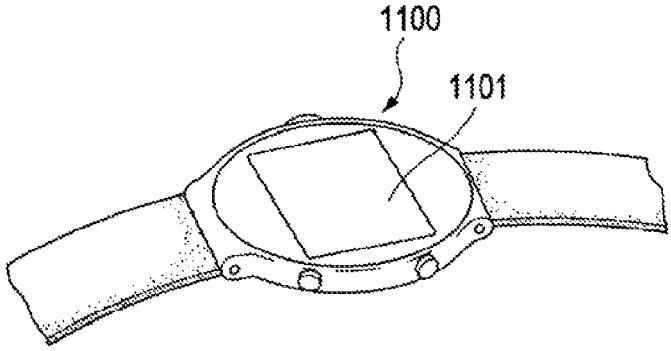
Figure 15C:
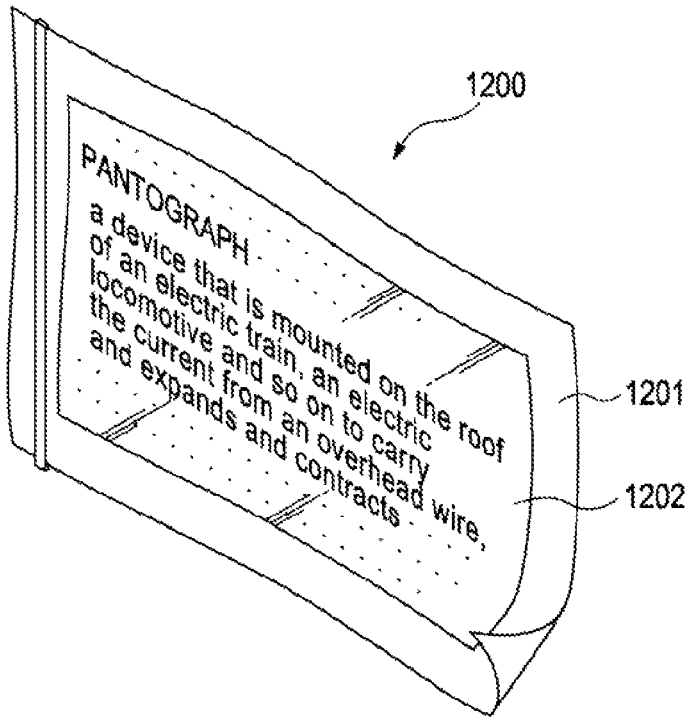

FIG. 13 is diagram illustrating a pixel circuit according to a second embodiment, and FIG. 14 is a plan view of a base plate according to the second embodiment. In the first embodiment described above, the storage capacitor Cs is formed between the electrode 10*a* and the electrode 10*b* that is extended from the scanning line 66 of a preceding stage. In such a configuration, there is a disadvantage in that, when a gate line is driven, an amount of load applied on the scanning line 66 becomes large. For example, when it is necessary to drive the scanning lines 66 at a high speed, owing to increasing screen sizes and higher resolutions, the large amount of load applied on the scanning lines 66 causes slow responses to the drives, and this slow responses are likely to pose troubles in operations performed as an object for display.

In a pixel circuit of this embodiment, the capacitance thereof is not reduced while the load applied on the scanning lines 66 are reduced. As shown in FIGS. 13 and 14, such a pixel circuit includes a storage capacitor line 69, in addition to the pixel circuit shown in the first embodiment.

The storage capacitor line 69 is connected to the common electrode or a low voltage power supply line. Between the pixel electrode 35 and the storage capacitor line 69, a storage capacitor Csa (a first capacitor) is provided, between the pixel electrode 35 and the scanning line 66, a storage capacitor Csb (a second capacitor) is provided, and these two storage capacitors Csa and Csb are connected in parallel with each other. Thus, the capacitance of the storage capacitor Cs in a pixel circuit for a pixel is a summation of that of the storage capacitor Csa and that of the storage capacitor Csb.

Such a configuration enables the storage capacitor Cs of a pixel to be separated into the two capacitors Csa and Csb, thus, reduces the load applied on the scanning line 66, and as a result, becomes a useful configuration for high-speed operations. Further, in this embodiment as well, for example, the scanning line 66 forming the electrode 10*b*, i.e., the other electrode of the capacitor Csb, is an i-th line of the scanning lines 66, which is driven immediately before the scanning line 66, to which the pixel 40A connected to the one electrode of the relevant capacitor Csb corresponds, is driven. Therefore, even in such a configuration, an electric-potential change of the scanning line 66 of a preceding stage causes a fluctuation of an electric potential of the pixel electrode 35 due to a capacitance coupling, and thus, the effects of reducing occurrences of an image retention and realizing high-speed responses are maintained.

As described above, in this embodiment, by forming the storage capacitor Cs between the electrode 10*a* and the electrode 10*b* that is extended from the scanning line 66 of a preceding stage, a pixel circuit, which enables ensuring a large storage capacitance along with maintaining a sufficient aperture ratio, has been realized.

Further, such a pixel circuit has brought an achievement of the electrophoretic display 200, which is capable of, in addition to realizing high resolutions, suppressing a variation of a field-though voltage to a low level, reducing occurrences of an image retention, and performing operations at a high speed.

In addition, in these embodiments, examples in which an amorphous silicon TFT is used as a thin film semiconductor element are provided; however, but a channel-etch-type amorphous silicon TFT, an HIPS, an LIPS, an oxide TFT or an organic TFT may be used.

Further, in FIG. 1, i.e., a diagram illustrating the whole of a configuration, drivers are incorporated; however, the scanning lines 66 and the data lines 68 may be driven by ICs connected thereto.

Further, although omitted from illustration, protection diodes may be incorporated.

In addition, members forming respective elements in these embodiments are not limited to the above-described members. With respect to the base plate 30 and the opposite plate 31, an organic material except PET or an inorganic material except a glass material may be used. As a material forming the source electrode 41*c*, the drain electrode 41*d* and the gate electrode 41*e*, a metallic material except an aluminum material or an organic material may be used. As a semiconductor material, an oxide semiconductor or an organic semiconductor, such as AGZO except a-IGZO, ZnO or AZO, or an inorganic material, such as amorphous hydroxide or polycrystalline silicon, may be used.

With respect to film thicknesses, film thicknesses other than those having been described above may be used.

Manufacturing methods are not limited to the plasma CVD method, the sputter method and the photo etching method. A coating method, such as an ink-jet method, may be used.

In the above-described embodiments, a TFT having a bottom gate structure is used; however, by using a TFT having a top gate structure, the same configuration as or a configuration similar to that of each of the above-described embodiments can be achieved.

Further, in the above-described embodiments, the capsule-type electrophoretic elements 32 are used; however, other methods can be adopted. For example, it is possible to configure so that, between a pair of substrates, partition walls are formed, and in spaces formed by the pair of substrates and the partition walls, electrophoretic elements are encapsulated.

Hereinbefore, preferred embodiments according to the invention have been described with reference to accompanying drawings; however, it goes without saying that the invention is not limited to the embodiments. It is apparent to those skilled in the art that various changes and modifications can be conceived within the scope of technical concept of the appended claims, and, it is naturally understood that they also belong to the technical scope of the invention.

Electronic Device

Next, cases, in which the electrophoretic display 100 according to the above-described embodiments is applied to electronic devices, will be hereinafter described.

FIGS. 13A, 13B and 13C are perspective views each illustrating a specific example of an electronic device to which the electrophoretic display 100 according to some aspects of the invention are applied.

FIG. 13A is a perspective view illustrating an electronics book, which is an example of the electronic device. The electronics book 1000 is configured to include a book-shaped frame 1001, a cover 1002, which is connected to the frame 1001 so as to be rotatable (openable and closable), an operation unit 1003, and a display unit 1004 configured by an electrophoretic display according to some aspects of the invention.

FIG. 13B is a perspective view illustrating a wristwatch, which is an example of the electronic device. This wristwatch 1100 is configured to include a display unit 1101 configured by an electrophoretic display according to some aspects of the invention.

FIG. 13C is a perspective view illustrating an electronics paper, which is an example of the electronic device. This electronics paper is configured to include a body unit 1201 configured by a rewritable sheet having a texture and flexibility just like those of a sheet of paper, and a display unit 1202 configured by an electrophoretic display according to some aspects of the invention.

For example, for the electronics book, the electronics paper and the like, since an application, in which characters are repeatedly written onto a white background, is assumed, it is necessary to eliminate an image retention after erasure, and an image retention over time.

In addition, the scope of electronic devices to which an electrophoretic display according to some aspects of the invention can be applied is not limited to these electronic devices, but widely includes apparatuses each utilizing perceivable color-tone variations in conjunction with movements of electrically charged participles.

Each of the electronics book 1000, the wristwatch 1100 and the electronics paper 1200 having been described above employs an electrophoretic display according to some aspects of the invention, and thus, is an electronic device including a display means of low power consumption.

In addition, the above-described electronic devices are just examples of an electronic device according to some aspects of the invention, and do not limit the technical scope of the invention. For example, an electrophoretic display according to some aspects of the invention can be suitably used for a display unit included in an electronic device, such as an IC card, a rewritable paper, a mobile telephone, a portable audio device, a PDA, an electronics dictionary, a fingerprint authentication apparatus, a central arithmetic processing apparatus, an electronics Japanese fan, an electronics price tag, and an electronics advertisement.

What is claimed is:

1. An electrophoretic display comprising:

a first substrate;

a second substrate;

an electrophoretic element interposed therebetween;

a plurality of scanning lines on an electrophoretic element side surface of the first substrate;

a plurality of data lines extending in the crosswise directions of the plurality of scanning lines on the electrophoretic element side surface of the first substrate;

a first selection transistor directly electrically connected to a first scanning line and a first data line;

a second selection transistor directly electrically connected to a second scanning line and the first data line;

a first pixel electrode directly electrically connected to the first selection transistor;

a second pixel electrode directly electrically connected to the second selection transistor; and a capacitor with two electrodes, one electrode thereof being directly electrically connected to the second selection transistor and the second pixel electrode, and the other electrode thereof being directly electrically connected to the first scanning line, wherein a plurality of pixel electrodes are arranged so that a dot density thereof is more than or equal to 200 dpi.

2. The electrophoretic display according to claim 1, wherein the first scanning line is driven immediately before the second scanning line.

3. An electronic device comprising the electrophoretic display claim 2.

4. An electronic device comprising the electrophoretic display claim 1.

5. The electrophoretic display according to claim 1, wherein the other electrode of the capacitor is an extending section of the first scanning line.

6. An electrophoretic display comprising:

a first substrate;

a second substrate;

an electrophoretic element interposed therebetween;

a plurality of scanning lines on an electrophoretic element side surface of the first substrate;

a plurality of data lines extending in the crosswise directions of the plurality of scanning lines on the electrophoretic element side surface of the first substrate;

a first selection transistor directly electrically connected to a first scanning line and a first data line;

a second selection transistor directly electrically connected to a second scanning line and the first data line;

a first pixel electrode directly electrically connected to the first selection transistor;

a second pixel electrode directly electrically connected to the second selection transistor; and a capacitor with two electrodes, one electrode thereof being directly electrically connected to the second selection transistor and the second pixel electrode, and the other electrode thereof being directly electrically connected to the first scanning line, wherein a parasitic capacitance Cgs of the first selection transistor is less than or equal to 1% of a capacitance Cs of the capacitor.

7. An electronic device comprising the electrophoretic display claim 6.

8. The electrophoretic display according to claim 6, wherein the other electrode of the capacitor is an extending section of the first scanning line.

9. An electrophoretic display comprising:

a first substrate;

a second substrate;

an electrophoretic element interposed therebetween;

a plurality of scanning lines on an electrophoretic element side surface of the first substrate;

a plurality of data lines extending in the crosswise directions of the plurality of scanning lines on the electrophoretic element side surface of the first substrate;

a plurality of capacitor lines formed so as to correspond to the respective scanning lines or the respective data lines;

a first selection transistor directly electrically connected to a first scanning line and a first data line;

a second selection transistor directly electrically connected to a second scanning line and the first data line;

a first pixel electrode directly electrically connected to the first selection transistor;

a second pixel electrode directly electrically connected to the second selection transistor; and a capacitor having one electrode directly electrically connected to the second selection transistor and the second pixel electrode, wherein the capacitor includes a first capacitor having the other electrode directly electrically connected to the first scanning line, and a second capacitor having the other electrode directly electrically connected to one of the capacitor lines.

10. An electronic device comprising the electrophoretic display claim 9.

11. The electrophoretic display according to claim 9, wherein the other electrode of the first capacitor is an extending section of the first scanning line.

* * * * *